US010786054B1

(12) United States Patent
Rosado

(10) Patent No.: US 10,786,054 B1
(45) Date of Patent: Sep. 29, 2020

(54) HIGH VISIBILITY VEST WITH HANDS FREE UMBRELLA DEVICE

(71) Applicant: Larry Rosado, Orlando, FL (US)

(72) Inventor: Larry Rosado, Orlando, FL (US)

( * ) Notice: Subject to any disclaimer, the term of this patent is extended or adjusted under 35 U.S.C. 154(b) by 0 days.

(21) Appl. No.: 16/703,652

(22) Filed: Dec. 4, 2019

(51) Int. Cl.
*A45B 11/02* (2006.01)
*A41D 13/01* (2006.01)
*A45B 25/18* (2006.01)

(52) U.S. Cl.
CPC ..... *A45B 11/02* (2013.01); *A41D 13/01* (2013.01); *A45B 25/18* (2013.01)

(58) Field of Classification Search
CPC ..... A45B 11/02
See application file for complete search history.

(56) References Cited

U.S. PATENT DOCUMENTS 725,069 A * 4/1903 Gill ..... A45B 11/02 224/190
1,041,577 A * 10/1912 Bekkevar ..... A45B 11/02 224/190
1,205,917 A * 11/1916 Merrill ..... A45B 11/02 224/190
1,347,540 A * 7/1920 Godard ..... A45B 11/02 224/190
5,033,528 A * 7/1991 Volcani ..... A45B 17/00 160/351
5,918,612 A * 7/1999 Hughes ..... A45B 11/02 135/16
6,024,464 A * 2/2000 De Vera ..... A45B 3/04 224/190
6,267,482 B1 * 7/2001 Miller ..... A41D 13/01 362/103
6,926,018 B1 * 8/2005 Ryo ..... A45B 11/02 135/15.1
7,275,668 B1 * 10/2007 Carroll ..... A45B 11/02 135/16
7,377,663 B2 * 5/2008 Desjardin ..... A41D 13/01 362/103
7,641,085 B2 * 1/2010 Nickels ..... A45B 11/02 224/188
9,351,548 B2 * 5/2016 Lorenz ..... A45B 11/04

* cited by examiner

*Primary Examiner* — Noah Chandler Hawk
(74) *Attorney, Agent, or Firm* — Jason T. Daniel, Esq.; Daniel Law Offices, P.A.

(57) ABSTRACT

A hands-free umbrella device includes a vest having a waist strap and a pair of shoulder straps. The vest is constructed from a lightweight material having high visibility markings along a portion or the entire body. An umbrella assembly is removably connected to the vest, and includes a central pole, a control mechanism, a rib assembly and a canopy. A plurality of retention members is disposed along the back portion of the vest for receiving an elongated shaft that is connected to the umbrella assembly. The elongated shaft includes a user adjustable shape, and the retention members are arranged to position the umbrella assembly over the left or right shoulder of a wearer. The umbrella assembly is telescopically engaged to the elongated shaft and a height of the umbrella canopy is adjustable.

12 Claims, 3 Drawing Sheets

HIGH VISIBILITY VEST WITH HANDS FREE UMBRELLA DEVICE

TECHNICAL FIELD

The present invention relates generally to umbrellas and shade producing devices, and more particularly to a hands-free variant of an umbrella.

BACKGROUND

The statements in this section merely provide background information related to the present disclosure and may not constitute prior art.

When working outdoors for long periods of time, workers will often encounter harsh weather conditions such as rain or extreme heat. Unfortunately, workers are often unable to utilize proper shade or shelter devices as they must continually use their hands and/or move about the job site.

Additionally, most employers require their employees and contractors to wear brightly colored reflective vests at all times on a job site so as to be visible to heavy machinery operators and/or vehicular traffic passing along or through the site. Although useful for allowing the wearer to be visible, these vests serve no other useful purpose.

Accordingly, it would be beneficial to provide an improved high visibility vest having an integrated handsfree umbrella system so as to overcome the drawbacks of the above noted devices and provide increased usability, safety and comfort to wearers.

SUMMARY OF THE INVENTION

The present invention is directed to a hands-free umbrella device. One embodiment of the present invention can include a vest having a waist strap and a pair of shoulder straps. The vest can be constructed from various lightweight materials and can preferably include high visibility markings along a portion or the entire body. An umbrella assembly is removably connected to the vest, and can include a central pole, a sliding control mechanism, a rib assembly and a canopy.

In one embodiment, a plurality of retention members is disposed along the back portion of the vest for receiving an elongated shaft that is connected to the umbrella assembly. The elongated shaft can include a user adjustable shape, and the retention members can be arranged so as to position the umbrella assembly over the left or right shoulder of a wearer.

In one embodiment, the umbrella includes functionality for transitioning between an open position and a closed position. In one embodiment, the umbrella assembly is telescopically engaged to the elongated shaft and a height of the umbrella canopy is adjustable.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, the term "removably secured," and derivatives thereof shall be used to describe a situation wherein two or more objects are joined together in a non-permanent manner so as to allow the same objects to be repeatedly joined and separated.

As described herein, the terms "connector" and "complementary connector" include any number of different elements that work together to repeatedly join two items together in a nonpermanent manner. Several nonlimiting examples include opposing strips of hook and loop material (i.e. Velcro®), attractively-oriented magnetic elements, flexible strips of interlocking projections with a slider (i.e., zipper), tethers, buckles such as side release buckles, and compression fittings such as T-handle rubber draw latches, hooks, snaps and buttons, for example. Each illustrated connector and complementary connector can be permanently secured to the illustrated portion of the device via a permanent sealer such as glue, adhesive tape, or stitching, for example.

Figure 1:
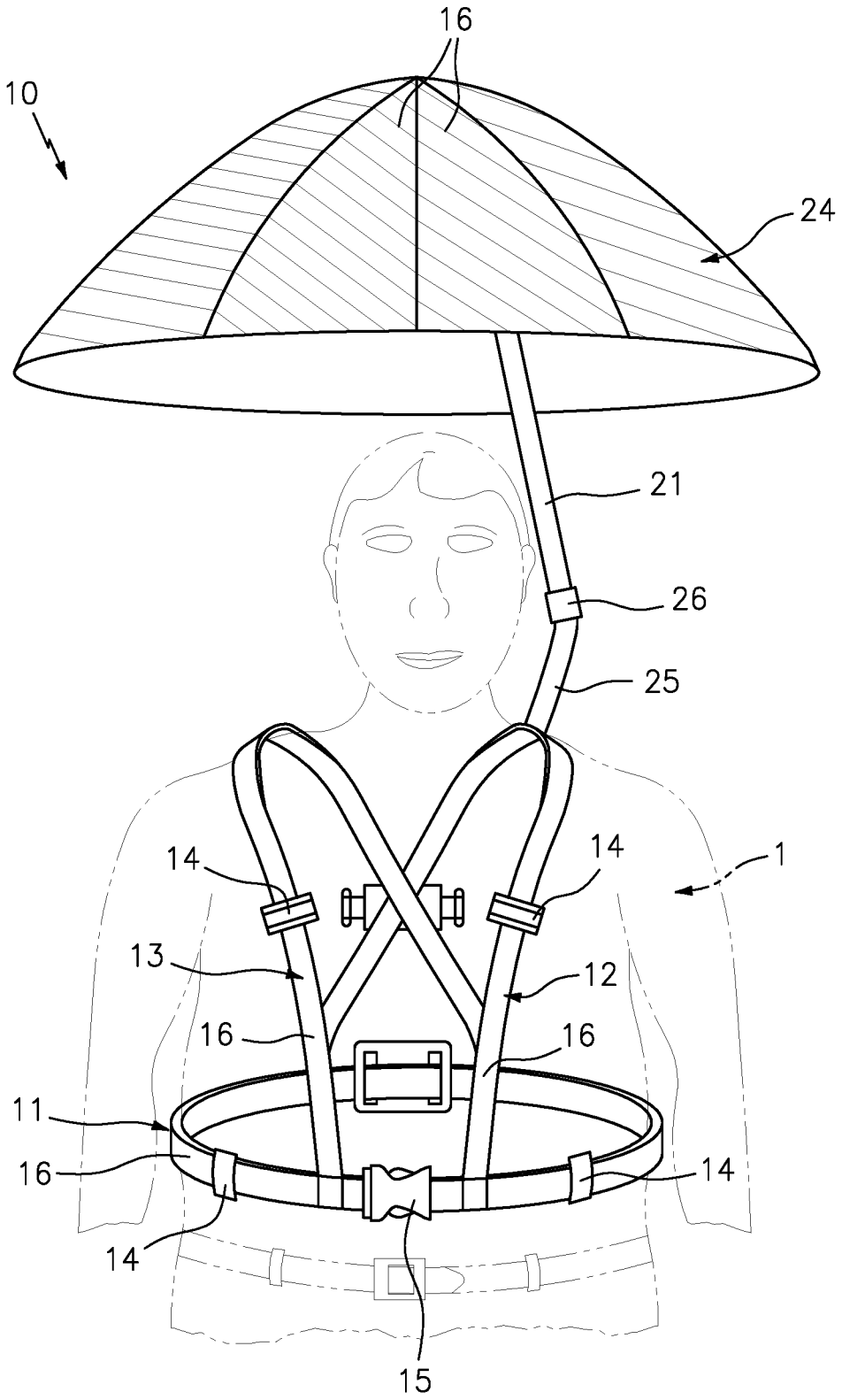
FIG. 1 is a front perspective view of the high visibility vest with hands free umbrella device that is useful for understanding the inventive concepts disclosed herein.
Figure 2:
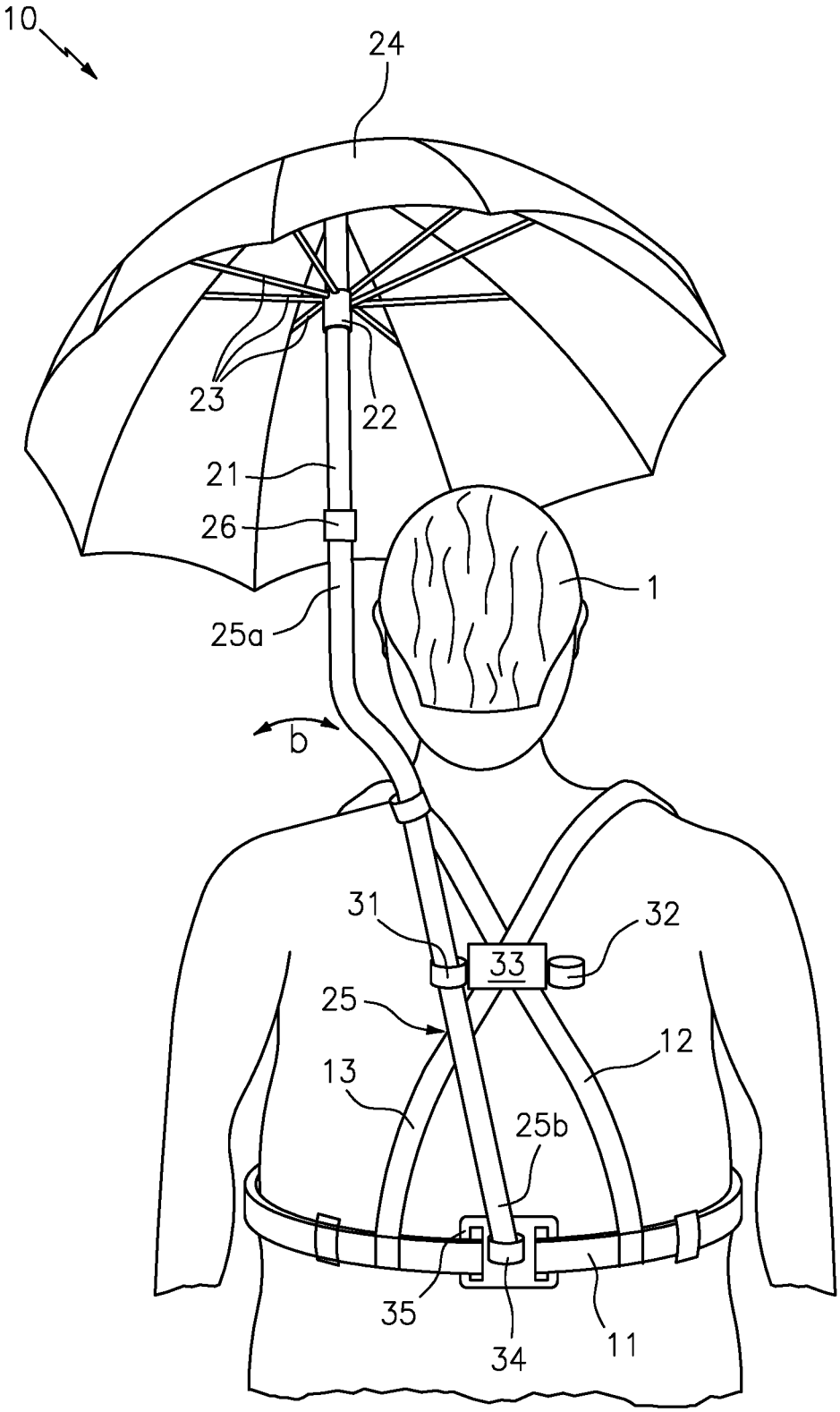
FIG. 2 is a back perspective view of the high visibility vest with hands free umbrella device, in accordance with one embodiment of the invention.
Figure 3:
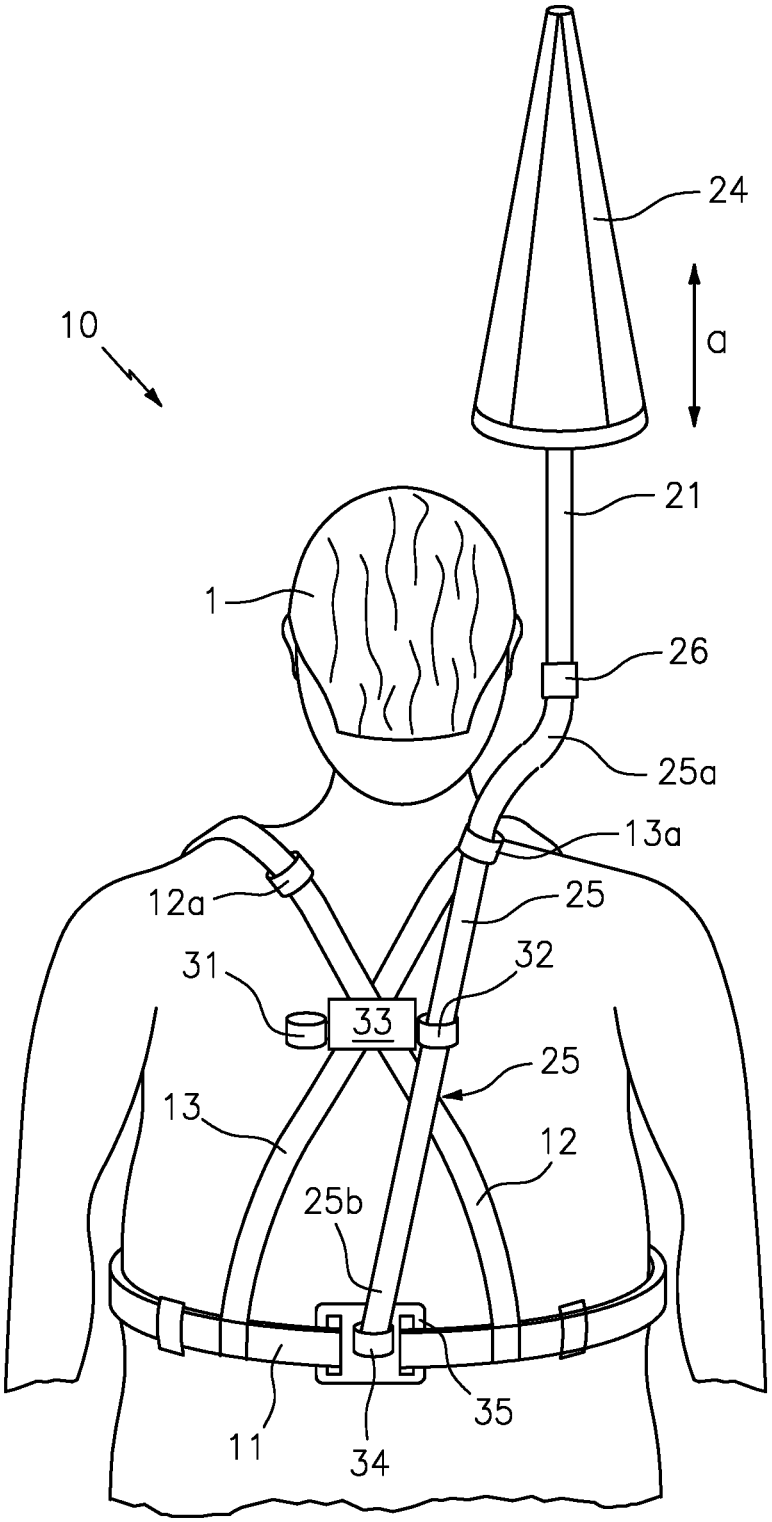
FIG. 3 is another back perspective view of the high visibility vest with hands free umbrella device, in accordance with one embodiment of the invention.

FIGS. 1-3 illustrate one embodiment of a vest with hands free umbrella device 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown best in FIG. 1, the vest portion of the device 10 can include a chest strap 11 which surrounds the chest/abdomen of a user 1, and a pair of shoulder straps 12 and 13 which are connected to the front and back facing portions of the chest strap 11 and extend over each of the user's shoulders. In one embodiment, the shoulder straps 12 and 13 are arranged diagonally along the back of the wearer and are joined together via the support patch 32 described below.

In the preferred embodiment, each of the straps 11-13 can be constructed from an elongated malleable material such as polyester webbing, for example, and can be joined together via stitching or other known construction techniques. Additionally, each of the straps can include length adjustment mechanisms 14 such as the illustrated slide buckles, and the waist strap can include a connector 15 such as the illustrated side release buckle, for example.

Additionally, in the preferred embodiment, high visibility markings 16 such as neon coloring, reflective tape, and/or incandescent paint can be provided along the entire vest so as to increase visibility of the wearer.

Of course, any number of other construction materials, length adjustment mechanisms and connectors capable of adjusting and/or joining the strap components together are also contemplated, so as to allow a user to adjust the fit of the vest to their particular body size and/or comfort requirements.

As shown best at FIGS. 2 and 3, an umbrella assembly can be removably secured along the back side of the vest, so as to be worn by the user. In one embodiment, the umbrella assembly can include a central pole 21 having a sliding control mechanism 22 that is in communication with a rib assembly 23 for selectively transitioning the waterproof fabric canopy 24 between an open and closed orientation. In the preferred embodiment, the canopy 24 will also include high visibility markings 16 along the entirety so as to increase visibility of the wearer.

As described herein, the central pole 21 can include a rigid shaft along which the sliding control mechanism can move, or the central pole can be constructed from a plurality of rigid shafts that are telescopically positioned so as to be adjustable in length. Each of these arrangements are well known in the art.

In one embodiment, the umbrella assembly can also include an elongated shaft 25 having a top end 25*a* and a bottom end 25*b*. As shown, the top end of the shaft 25*a* can be removably or permanently secured to the bottom end of the central pole 21 via a clamp 26 or other type of connector. In one embodiment, the top of the shaft 25 can include an opening and a hollow interior into which the bottom portion of the pole 21 can be positioned. In such embodiments, the connector 26 can include a threaded clamp which (when loosened) can allow the central pole to telescope away from and within the shaft. Such a feature allowing a user to adjust the height of the umbrella as shown by arrow a.

The shaft 25 can include any number of different lengths and can be constructed from either a rigid material or a material which allows flexion in three dimensions in order to allow a user to bend and/or orient the umbrella at any number of different positions as shown by arrow b and for the shaft to maintain the user-defined position (i.e., position memory). As described herein, the shaft 25 may be constructed from any number of different materials such as various soft metals, alloys and/or flexible plastics, for example.

As shown in FIGS. 2 and 3, the shaft 25 can be connected to the back side of the vest so as to extend above either the left or right shoulder of the wearer. In this regard, the vest can include a pair of upper retention loops 12*a* and 13*a*, a support patch assembly 33, and a lower retention pocket 34.

In one embodiment, a support patch assembly 33 can be constructed from an identical material as the vest and can include a central body section that is stitched to each of the straps 12 and 13 where they intersect. A pair of retention loops 31 and 32 can be formed along each side of the patch and can each comprise hollow vertical channels for individually receiving the elongated shaft 25 when the same is to be positioned in a left or right side configuration, respectively. In this regard, the support patch assembly advantageously performs two distinct functions, as it 1) functions to align and maintain the position of the shoulder straps 12-13, and 2) provides a connection point for positioning and securing the shaft to the users back.

In one embodiment, the lower retention pocket 34 can also be constructed from the same material as the vest and can include an opening 35 into which the bottom end of the shaft 25*b* can be positioned. Padding (not illustrated) is preferably sealed within the pocket so as to provide a cushion against the users back. In various embodiments, the shaft can be permanently or removably positioned within the pocket.

In the preferred embodiment, the vest is preferably constructed with each of the retention loops 12*a*, 13*a*, 31, 32, patch 33, and pocket 34 as permanent elements, so as to ensure the overall vest remains lightweight (e.g., less than 8 ounces) and to allow the vest to be laundered repeatedly without damage or loss of function. However, other embodiments are contemplated wherein one or more of the retention loops 12*a*, 13*a*, 31, 32, patch 33, or pocket 34 are constructed from other materials, or are removably connected to the vest so as to be adjustable in nature.

Although described above as including a specific shaped vest having a specific number of components at specific locations along the vest, this is for illustrative purposes only, as the inventive concepts are not to be construed as limiting to the figures as shown. To this end, any number of different types or shapes of vests/garments capable of being worn by a user are also contemplated. Moreover, any number of different components capable of receiving an umbrella assembly having any number of different shapes are also contemplated.

As described herein, one or more elements of the hands-free umbrella device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A hands-free umbrella device, comprising:

a vest having a waist strap and a pair of shoulder straps;

at least one retention member that is disposed along a rear facing portion of one or more of the waist straps or the pair of shoulder straps;

an umbrella assembly having a telescoping central pole, a sliding control mechanism, a rib assembly and a canopy;

an elongated shaft having a top end and a bottom end; and a connector that is positioned between the top end of the elongated shaft and a bottom end of the central pole, wherein the connector is removably secured to the vest via the at least one retention member, wherein the umbrella assembly is telescopically connected to the elongated shaft, and wherein the at least one retention member comprises: a first retention loop that is positioned along an upper end of a left shoulder strap of the pair of shoulder straps, a second retention loop that is positioned along an upper end of a right shoulder strap of the pair of shoulder straps, a support patch that is in communication with a middle portion of each of the left shoulder strap and the right shoulder strap, a left support patch loop that is positioned along one side of the support patch adjacent to the middle portion of the left shoulder strap, a right support patch loop that is positioned along another side of the support patch adjacent to the middle portion of the right shoulder strap, and a pocket that is positioned along the waist strap at a position between the first retention loop and the second retention loop, wherein the pocket, the right support patch and the second retention loop are configured to receive the elongated shaft and to position the umbrella assembly above the right shoulder strap, and wherein the pocket, the left support patch and the first retention loop are configured to receive the elongated shaft and to position the umbrella assembly above the left shoulder strap.

2. The device of claim 1, wherein the elongated shaft is constructed from a malleable material.

3. The device of claim 1, wherein the elongated shaft is flexible in three dimensions and includes a memory for remaining in a user designated shape.

4. The device of claim 1, wherein the vest is constructed from a malleable material.

5. The device of claim 1, further comprising high visibility markings that are located along an entirety of the vest.

6. The device of claim 5, wherein the high visibility markings include, at least one of an incandescent material, a reflective material or a neon color material.

7. The device of claim 1, further comprising high visibility markings that are located along an entirety of an outside facing surface of the umbrella canopy.

8. The device of claim 7, wherein the high visibility markings include, at least one of an incandescent material, a reflective material or a neon color material.

9. The device of claim 1, wherein the at least one retention member includes a pair of retention loops that are located along each of the pair of shoulder straps.

10. The device of claim 1, wherein the at least one retention member includes a pocket that is positioned along a back facing portion of the waist strap.

11. The device of claim 1, wherein the at least one retention member includes each of a pair of retention loops that are located along each of the pair of shoulder straps; and a pocket that is positioned along a back facing portion of the waist strap.

12. A hands-free umbrella device, comprising:

a vest having a waist strap and a pair of shoulder straps;

at least one retention member that is disposed along a rear facing portion of one or more of the waist straps or the pair of shoulder straps;

an umbrella assembly having a telescoping central pole, a sliding control mechanism, a rib assembly and a canopy;

an elongated shaft having a top end and a bottom end; and a connector that is positioned between the top end of the elongated shaft and a bottom end of the central pole, wherein the connector is removably secured to the vest via the at least one retention member, wherein the umbrella assembly is telescopically connected to the elongated shaft, and wherein the at least one retention member consists of:

a first retention loop that is positioned along an upper end of a left shoulder strap of the pair of shoulder straps;

a second retention loop that is positioned along an upper end of a right shoulder strap of the pair of shoulder straps;

a support patch that is in communication with a middle portion of each of the left shoulder strap and the right shoulder strap;

a left support patch loop that is positioned along one side of the support patch adjacent to the middle portion of the left shoulder strap;

a right support patch loop that is positioned along another side of the support patch adjacent to the middle portion of the right shoulder strap; and a pocket that is positioned along the waist strap at a position between the first retention loop and the second retention loop.

* * * * *